US005481891A

United States Patent [19]

Sabine

[11] Patent Number: 5,481,891

[45] Date of Patent: Jan. 9, 1996

[54] TUBE BENDING APPARATUS AND METHOD

[75] Inventor: James R. Sabine, Burlington, Canada

[73] Assignee: Eagle Precision Technologies Inc., Brantford, Canada

[21] Appl. No.: 169,079

[22] Filed: Dec. 20, 1993

[51] Int. Cl.[6] ..... B21B 37/12

[52] U.S. Cl. ..... 72/24; 72/149; 72/151; 72/369

[58] Field of Search ..... 72/149, 151, 24, 72/369

[56] References Cited

U.S. PATENT DOCUMENTS 4,126,030 11/1978 Zollweg et al. .
5,142,895 9/1992 Schuchert .
5,259,224 11/1993 Schwarze ..... 72/149

FOREIGN PATENT DOCUMENTS 227529 10/1987 Japan ..... 72/149
290622 11/1990 Japan ..... 72/149

*Primary Examiner*—David Jones
*Attorney, Agent, or Firm*—Keck, Mahin & Cate

[57] ABSTRACT

The invention provides an apparatus for the rotary draw bending of pipe and tube having means to apply an axial boost force to the trailing end of the tube during the bending operation, which force assists in controlling the flow of tube material into the bend. The apparatus has means to monitor the amount of material being used during each bending operation and means to control the amount of boost applied to the tube whereby the bending operation can be controlled to better achieve desired elongation characteristics. Bent tubes to a consistent standard and quality are obtained.

4 Claims, 6 Drawing Sheets

TUBE BENDING APPARATUS AND METHOD

FIELD OF THE INVENTION

This invention relates to apparatus and methods for the rotary draw bending of rigid tubes, such as those of use in automotive exhaust systems, heat exchangers and aircraft hydraulic systems. In particular it concerns an improved apparatus and method for applying and controlling a boost force applied to the tube during the bending operation.

BACKGROUND OF THE INVENTION

In prior apparatus used for the rotary draw bending of pipe and tube, such as of use in automobile exhaust systems, heat exchangers and aircraft construction, a primary component is the bending head of the apparatus. The bending head comprises a rotary bend die, an opposing clamp die which clamps a section of the tube immediately preceding the section of the tube where the bend is to be formed, and a pressure die located directly behind the clamped section of the tube. As the tube is pulled around the rotary bend die, the pressure die moves substantially in unison with the tube while resisting the radial reaction force of the tube acting on the pressure die. Thus, the pressure die and rotary bend die cause the tube to be squeezed therebetween during the bending operation.

Many variable factors, such as the type of tube material, tube wall thickness, shape of the tube section to be formed, the radius of the bend, amount of impurities and the like, need to be considered when tube bending with rotary draw bending machinery is carried out. However, although commercially acceptable tubes are manufactured with apparatus hereinbefore described, there is a need for pipe bending methods and apparatus which are capable of producing tubes of a consistent, desired quality.

Slight changes in the values of the above variable factors during the bending operation may cause small, but significant variations in the elongation of the tube. These variations may cause the final part geometry of the tube to be unacceptable or may necessitate an additional trim operation if the length of the final straight section of the pipe has to be maintained within a defined tolerance.

Notwithstanding the slight changes in the values of the above variable factors, I have found that variations in the elongation of the tube can be significantly reduced to consistently provide an improved tube. Thus, by controlling the flow of tube material into the bend during the bending operation, a bent tube product can consistently be manufactured.

SUMMARY OF THE INVENTION

It is an object of the present invention to provide an apparatus for bending a tube consistently to an improved, desired standard.

It is a further object of the invention to provide a method of bending a tube to produce a bent tube of consistently uniform quality.

These and other objects of the invention will become apparent from a reading of this specification as a whole.

Thus, in its broadest aspect, the invention provides apparatus for the rotary draw bending of pipe and tube having means to apply an axial boost force to the trailing edge of the tube during the bending operation, which force assists in controlling the flow of tube material into the bend. The apparatus has means to monitor the amount of material being used during each bending operation and means to control the amount of boost force applied to the tube whereby the bending operation can be controlled to better achieve desired elongation characteristics.

The apparatus of the present invention, preferably, provides a boost cylinder that provides an axial boost force directly to the back of the tube through a tube collet. This boost cylinder is fitted with a control valve for setting the boost pressure applied to the tube, a pressure sensing means monitoring the boost pressure and a position sensing means for monitoring the location of the end of the tube during the bend.

As the tube is pulled around the bending form block of the apparatus, the position of the tube collet moves horizontally with the rear end of the tube. The rate of this motion determines the length of tube being used to form the bend. This length can be compared to the theoretical arc length of the formed bend arc based on the radius of the bending form block and the angular position of the bend arm associated with the bending form block. By comparing these values, the amount of elongation occurring in the tube during the bend can be determined.

As the bending operation proceeds, a control system compares the actual elongation occurring in the tube with the desired, pre-set elongation factor entered by an operator. If the tube is found to be stretching too much, additional boost force is applied to the back end of the tube with the boost system to reduce the stretch. Conversely, if the tube is found to be not elongating enough, the auxiliary boost force applied to the tube is reduced thereby increasing the stretch of the tube. By the automatic continuous monitoring of the degree of elongation and associated adjustment of the boost force throughout the bend, a consistent elongation characteristic can be achieved.

Accordingly, in one aspect the invention provides an improved tube rotary draw bending apparatus for bending a tube having a first portion and a second portion retained by said apparatus, said apparatus comprising a bend die around which a bend in said second portion of said tube is formed; means for retaining said first portion of said tube; means for applying a boost force to said first portion of said tube; the improvement comprising means to determine the relative position of said first portion and said second portion of said tube, one to the other, during the bending operation; means to determine operational stretch factor values created in said second portion of said tube from said relative positions during the bending operation; and boost force change means to change said boost force applied to said end portion in response to said operational stretch factor values to effect adjustment of said operational stretch factor values to a desired, pre-selected stretch factor value.

Preferably, the pre-selected stretch factor value is constant throughout the bending operation. In an alternative embodiment, the pre-selected stretch factor value may be pre-set to be variable throughout the bending operation.

More preferably, the first portion of the tube is a trailing end portion of the tube.

Thus, the present invention provides sophisticated programming and monitoring features for controlling the interaction between the bend die and the tube during the bending operation. The system includes feedback devices to monitor the relative positions of the end and bend portions of the tube and the boost force applied to the tube by a boost force cylinder during each bending operation.

The boost force may be provided by any means which is capable of applying sufficient force to the tube during bending to control the material elongation. This may be a hydraulic or electric actuator situated such that it is pushing directly on the trailing end of the tube. Alternatively, a clamping system could be provided which would grip an intermediate section of the tube behind the bend head and then provide an axial force through the clamping means.

The position feedback device is provided to monitor the position of, preferably, the trailing section of the tube. This can be done by using a linear encoder, a transducer or other suitable feedback device mounted to provide linear position feedback from the axial boost means. If a boosting means is used which does not act directly on the trailing end of the tube, care must be taken to ensure that the clamping means does not slip in relation to the tube during the boost operation.

The linear position feedback may also directly monitor the motion of the tube by having the tube pass between a set of rollers and then monitoring the rotational position of the rollers. Again, care must be taken to ensure that no slippage occurs between the rollers and the tube.

In order to determine the relationship between the trailing section of the tube and the section of tube where the bending is taking place, a means is also provided for monitoring the position of the bending action of the machine. On most current bending machines, this position feedback is provided to allow control of the degree of bending using a rotary encoder or resolver.

By monitoring both the position of the bending arm and the position of the trailing section of the tube, and by knowing the radius of the bending form block, it is possible to determine the actual stretch occurring in the tube at any time during the bend. The stretch factor is given by:

$$\frac{\text{(Arc length of current bend angle)} - \text{(Tube used to form current bend)}}{\text{Tube used to form current bend}}$$

where the arc length is calculated from the actual bend arm position and the radius of the bending form block and the tube used is determined directly from the motion of the trailing section of tube.

Thus, as the tube is pulled around the bending from block, the position of the trailing end of the tube determines the amount of tube being used to form the bend. This length can be compared to the theoretical arc length of the formed bend arc based on the radius of the bending form block and the angular position of the bend arm. By comparing these values, the amount of elongation occurring in the tube during the bend can be determined.

As the bend proceeds, a computer control system compares the actual elongation occurring in the tube with the preset, desired elongation factor entered by an operator. If the tube is found to be stretching too much, additional boost force is applied to the back end of the tube with the auxiliary boost system to reduce the stretch. Conversely, if the tube is found to be not elongating enough, the auxiliary boost force applied to the tube is reduced thereby increasing the stretch of the tube. By continuing to monitor the elongation and adjust the boost force throughout the bend, a consistent elongation characteristic can be achieved.

The desired elongation factor could be entered as a percentage stretch factor such that the length of tubing used to form the bend would be calculated as shown below:

$$\text{Tube Length Used} = \frac{\text{Theoretical Arc Length}}{1 + \text{Stretch Factor}}$$

where the theoretical arc length is determined from the radius of the bending form block and the angle of the bend to be made. This value would be entered based on knowledge of the forming properties of the tube material to be bent such that acceptable forming results would be achieved.

Thus, for a desired bend angle of 60 degrees made on a bending form block with a radius of 4.0 inches with a stretch factor of 5% , the $$\begin{aligned}
\text{Theoretical Arc Length} &= (2 \times \pi \times 4.0") \times 60 \text{ degrees} \div 360 \text{ degrees} \\
&= 10.540 \text{ cm; and the} \\
\text{Tube Length Used} &= 4.189 \div (1 + 0.05) \\
&= 10.160 \text{ cm}
\end{aligned}$$

An alternative method of defining the elongation factor is to specify the desired length of the last straight in the part. The control system would then calculate the theoretical length of the last straight based on the theoretical arc lengths of all the bends in the tube. The appropriate stretch factor could then be determined such that the desired last straight length would be achieved. This would be the preferred method if the goal of the elongation control were to eliminate the need for a trimming operation after bending.

BRIEF DESCRIPTION OF THE DRAWINGS

In order that the invention may be better understood, a preferred embodiment will now be described, by way of example only, with reference to the accompanying drawings wherein.

DESCRIPTION OF A PREFERRED EMBODIMENT

Figures 1, 1A:
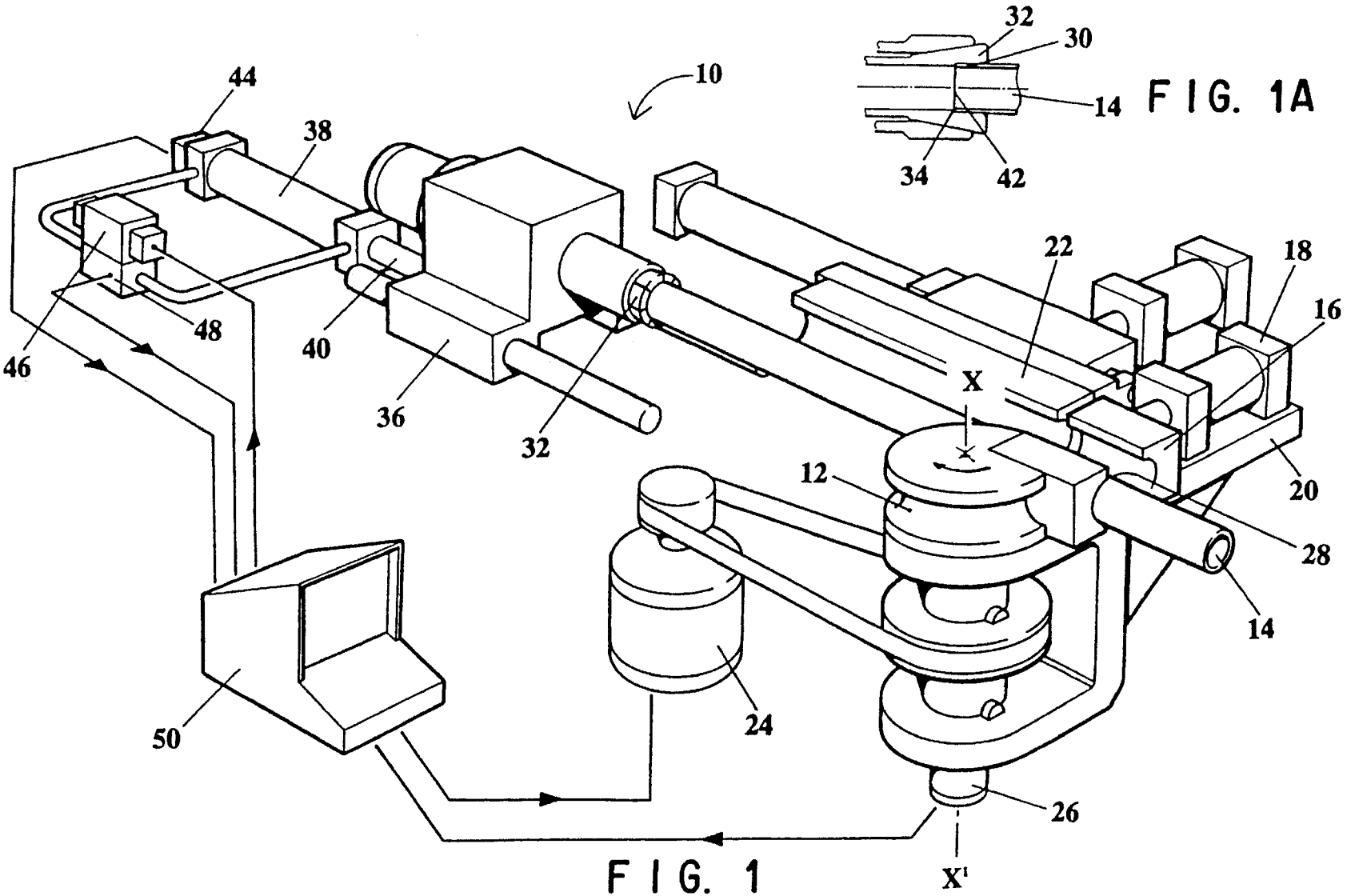
FIG. 1 is a diagrammatic, perspective view of a bending apparatus according to the invention, control means for use therewith, a tube located therein in a non-clamped, pre-bend position
FIG. 1A is cross-sectional axial view of a part thereof.
Figure 2:
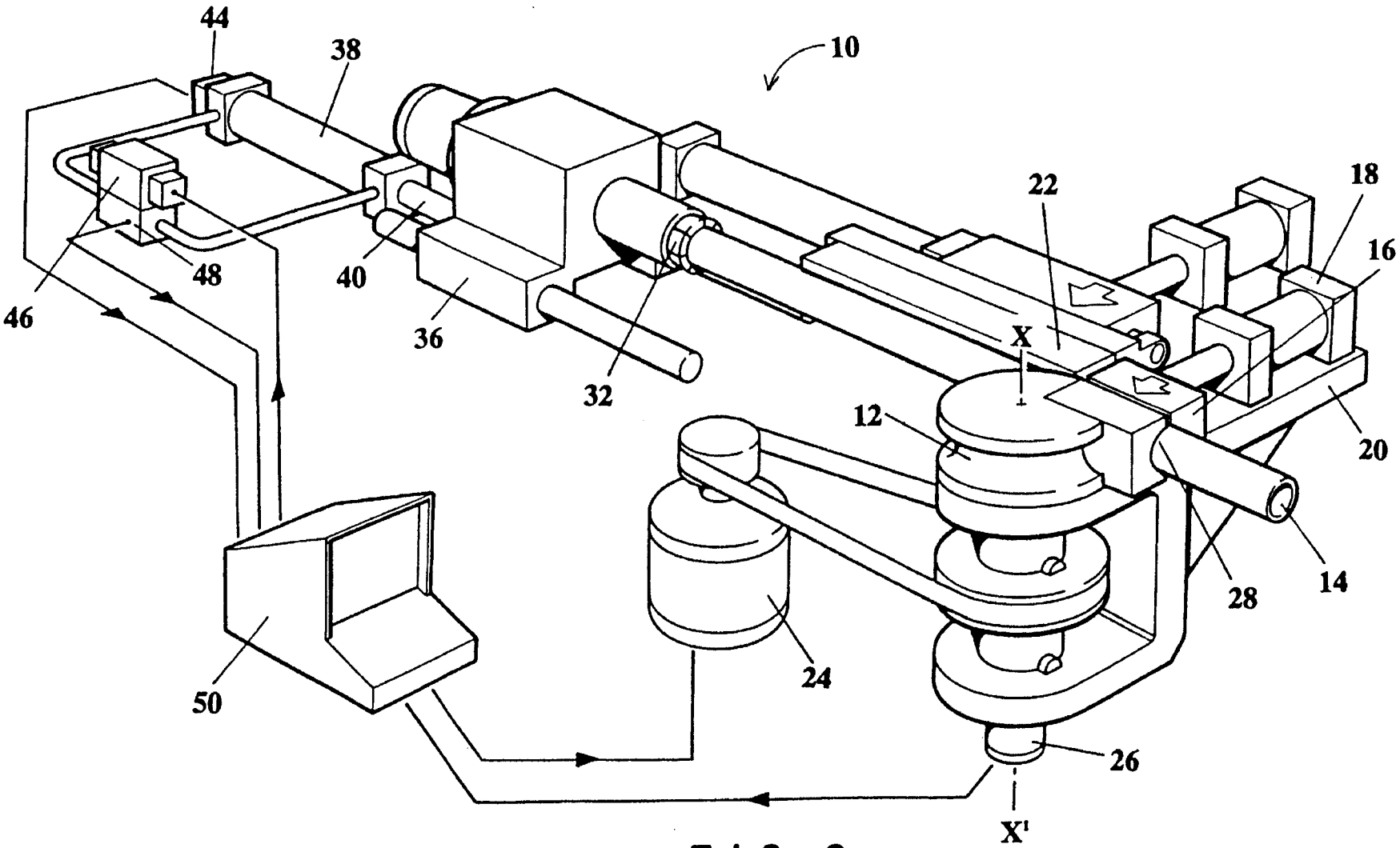
FIG. 2 is a diagrammatic, perspective view of the bending apparatus as shown in FIG. 1, wherein the tube is in a clamped, pre-bend position.
Figure 3:
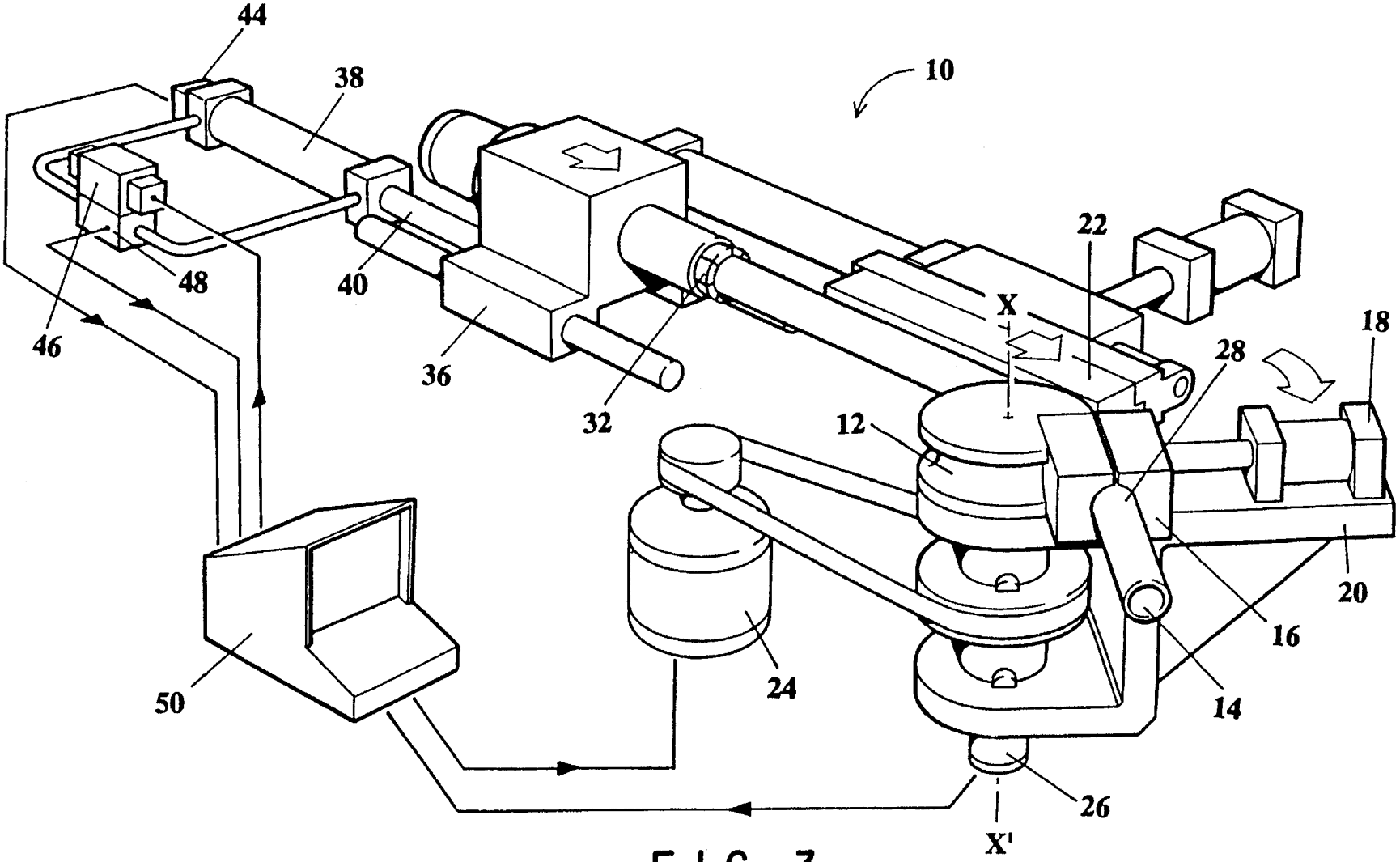
FIG. 3 is the apparatus as shown in FIG. 2 wherein the tube is in a clamped post-bend position.

With reference to FIGS. 1–3, a bending machine, shown generally as 10, has a bending form block 12 around which a tube 14 is formed. During the bending operation, tube 14 is held against forming block 12 by a clamp block 16 and a clamping cylinder 18, both mounted on a bend arm 20 which is rotatable around the bending axis X–X'. A further tooling block 22 is held against tube 14 during the bending operation to resist the reaction forces created in tube 14 by the bending moment.

Bend arm 20 is driven by a bend arm actuator 24 which provides the bending power to form tube 14. A position feedback encoder 26 is provided as means for monitoring the instantaneous position of bend arm 20. Tube 14 has a front section 28 which is essentially fixed to bend arm 20 by clamp block 16 so that during a bending operation, the position of bend arm 20 also determines the position of front section 28 of tube 14 relative to the unbent condition.

Tube 14 has a trailing end portion 30, which is grasped in a tube collet 32. Collet 32 contains a fixed tube stop 34 which abuts end of tube 14 and acts as a position register when loading tube 14 into machine 10. Collet 32 is carried along the bed of machine 10 on a tube carriage 36 to position tube 14 relative to bending form block 12 prior to bending.

A hydraulic boost cylinder 38 having a piston rod 40 is mounted on bending machine 10 such that it can exert a boosting force against the back of tube carriage 36 during a bending operation. This force is transmitted to tube 14 since collet 32 is fixed to carriage 36 and trailing end 30 of tube 14 is abutted to collet tube stop 34 at surface 42.

A linear position transducer 44 is mounted on boost cylinder 38 to provide position feedback from piston rod 40. Since piston rod 40 is attached to the back of tube carriage 36, which is in turn attached to tube collet 32 and tube 14 via collet tube stop 34, position feedback transducer 44 also determines the movement of trailing end 30 of tube 14 during the bending operation.

A boost control valve 46 is provided for boost cylinder 38 to provide electronic control of the boost force applied to tube 14. A boost pressure transducer 48 provides a monitoring means for the boost pressure.

FIGS. 1–3 further show a digital computer system 50 which embodies electronic hardware and software to interpret the feedback from position encoders 26 and 44, plus the boost transducer 48 during the bending operation.

Means are further provided for digital computer 50 to generate a command signal for boost control valve 46 and means for interpreting the feedback from boost force transducer 48. Prior to the bending operation, an operator has to enter the radius value of bending form block 12 and the desired stretch factor.

During each bending operation, control system 50 monitors the position of section 28 of tube 14 based on the position feedback from bend arm encoder 26. The length of the arc formed by the indicated angle is then calculated based on the preselected radius of bending form block 12. After allowing for the preselected stretch factor, the amount of tube 14 which is desired to form the current arc is determined.

The actual amount of tube 14 used to form the arc is then determined based on the position feedback from boost cylinder transducer 44. Since boost cylinder 38 can move only as fast as the trailing end 30 of tube 14 due to fixed tube stop 34 in collet 32, the amount of tube 14 used is exactly equal to the motion of boost cylinder 38.

Figure 4A:
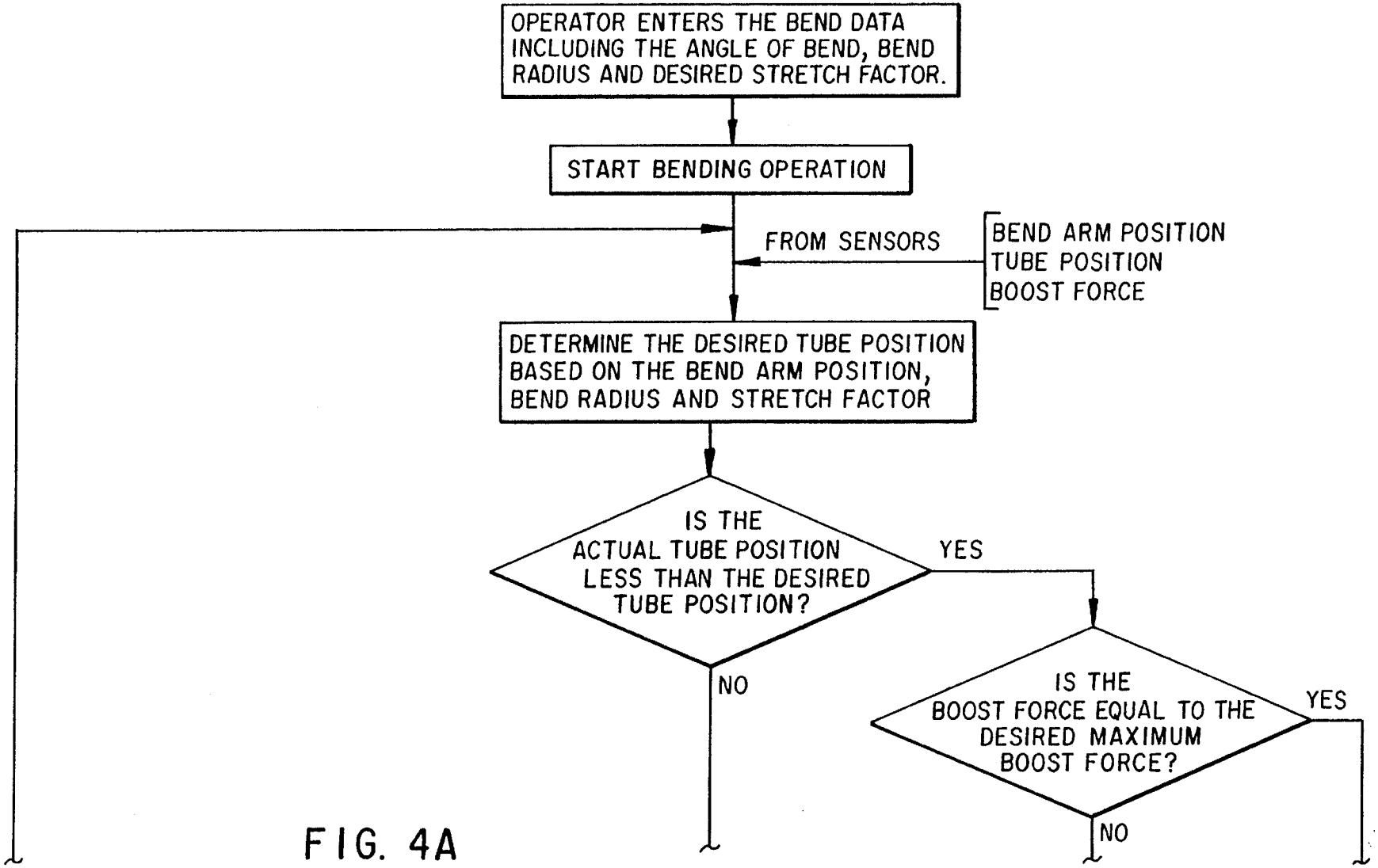
FIG. 4 represents a block diagram representing the control flow chart for operation during each bend.
Figure 4B:
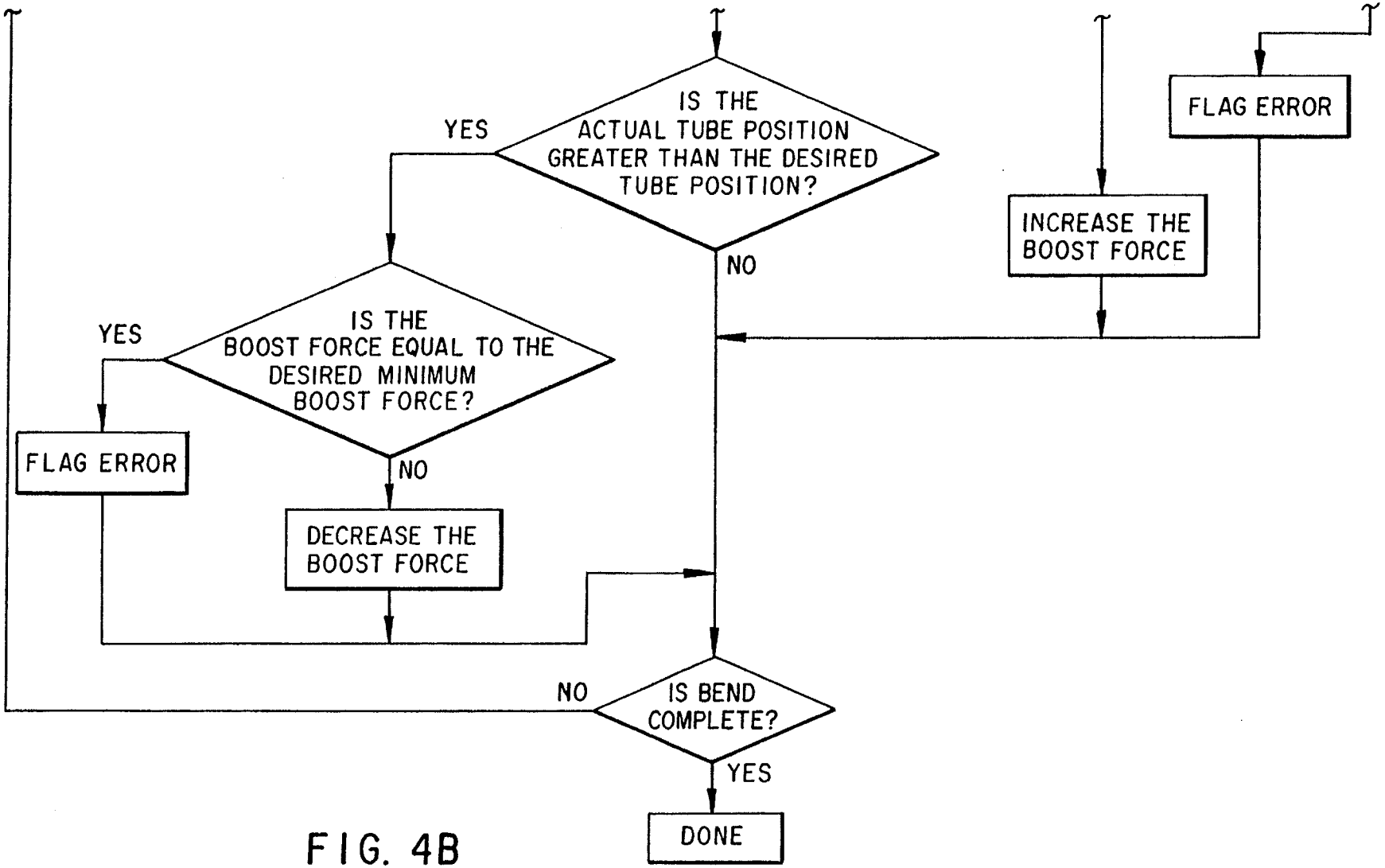

The control software embodied in system 50 then compares the desired tube usage with the actual usage to determine the actual instantaneous stretch factor occurring in tube 14 If this factor is greater than the pre-selected desired stretch factor, the command signal to the boost control value 46 is increased, thereby increasing the boost force applied to tube 14 and, thus, decreasing the stretch in tube 14. Conversely, if the actual stretch factor is less than the pre-selected desired stretch factor, the command signal to boost control valve 46 is decreased, thereby decreasing the boost force applied to the tube and thus increasing the stretch in the tube. This decision process is executed continuously throughout the bending operation to continuously adjust the applied boost force in relation to the actual stretch occurring in the tube. The flow chart for the control logic is shown in FIG. 4.

EXAMPLE

Figure 5:
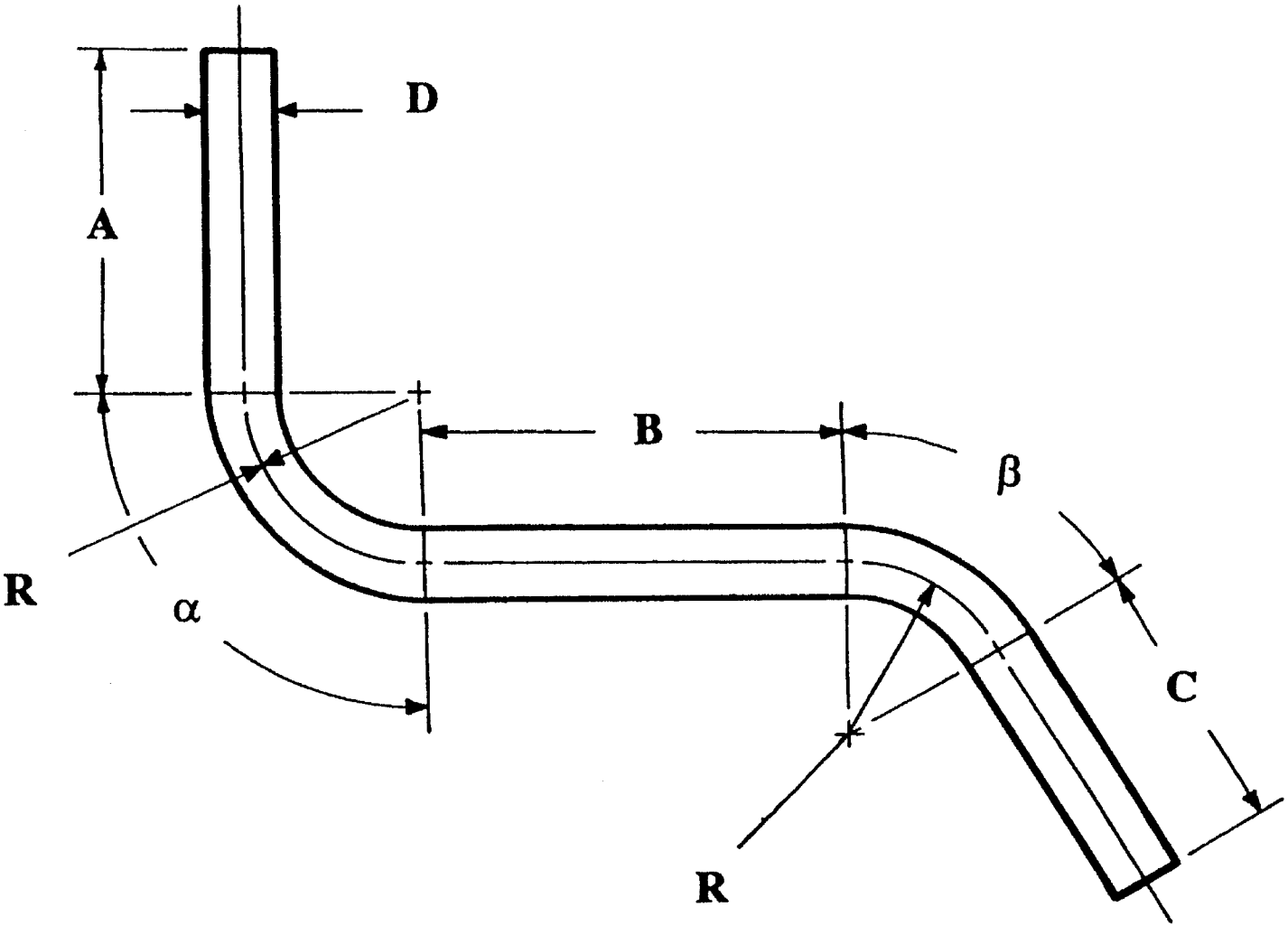
FIG. 5 is a diagrammatic representation of a tube bent with the apparatus according to the invention.

A tube of initial length of 106.68 cm bent according to the dimensions shown in FIG. 5, having a first straight length 'A' of 25.4 cm, a first bend '$\alpha$' of 90 degrees with a radius 'R' of 12.70 cm, a second straight length 'B' of 30.48 cm, a second bend '$\beta$' of 60 degrees with a radius R of 12.70 cm and a final straight length 'C' of 20.32 cm.

The theoretical length of the last straight length 'C' is calculated as follows:

| | | |
|---|---|---|
| Theoretical Arc Lengths | = | $(2 \times \pi \times 12.70) \times ((60 \div 90) \div 360)$ |
| | = | 33.25 cm |
| Last Straight Length | = | 106.68 cm – Straight Sections A and B – Arc Lengths |
| | = | 17.55 cm |

Since the theoretical last straight (with no stretch) will be 17.55 cm and the desired last straight length is 20.32 cm, the tube must be stretched by 2.77 cm during the bending operations. Therefore, when forming the bends:

| | | |
|---|---|---|
| Tube Length Used | = | 33.25 cm – 2.77 cm |
| | = | 30.48 cm |
| Stretch Factor | = | Theoretical Arc Length ÷ Tube Length Used |
| | = | 33.25 ÷ 30.48 |
| | = | 1.09 or 9% |

This stretch factor would then produce the desired length of the last straight section.

Thus the tube bending machine of the invention has the ability to apply a boost force directly to the back end of a tube during the bending operation and to monitor the position of the end of the tube and the position of the bend arm during the bending operation and to determine a stretch factor present in the process based on the relationship between these positions. The machine further has the ability to vary the boost force applied to the back of the tube such that the actual stretch occurring in the tube during the bending operation is maintained equal to a predetermined desired stretch factor. It has the ability to determine the required stretch factor for a given part geometer given the length of the initial tube such that the length of the last straight section in the tube can be specified and controlled.

While the invention has been described in detail and with reference to a specific embodiment thereof, it will be apparent to one skilled in the art that various changes and modifications can be made therein without departing from the spirit and scope of the invention as described and claimed.

I claim:

1. An improved tube rotary draw bending apparatus for bending a tube having a tube end, a first portion adjacent said tube end and a second portion retained by said apparatus, said apparatus comprising a bend die around which a bend in said first portion of said tube is formed; means for retaining said first portion of said tube; a tube stop abutting said tube end; means for applying a boost force to said tube end; the improvement comprising:

means to determined the relative position of said tube stop and said second portion of said tube, one to the other, during the bending operation;

means to determine operational stretch factor values created in said second portion of said tube from said relative positions during the bending operation; and boost force change means to change said boost force applied to said tube end in response to said operational stretch factor values to effect adjustment of said operational stretch factor values to a desired, pre-selected stretch factor value.

2. An apparatus as claimed in claim 1 whereby said means to determine said relative positions comprises means to determine the angular positions of said second portion prior to and during said bending operation relative to its position at the start of said bending operation.

3. An apparatus as claimed in claim 2 wherein said means to determine the angular positions of said second portion comprises an angular encoder.

4. An apparatus as claimed in claim 1 further comprising position sensing means to determine the position of said tube end.

* * * * *